US007471180B2

(12) United States Patent
Seong

(10) Patent No.: US 7,471,180 B2
(45) Date of Patent: Dec. 30, 2008

(54) TRANSFORMER HAVING MULTI-LAYERED WINDING STRUCTURE

(75) Inventor: Hwanho Seong, Gunpo-si (KR)

(73) Assignee: PSTEK Co., Ltd., Ansan, Kyunggi-do ( * ) Notice: Subject to any disclaimer, the term of this patent is extended or adjusted under 35 U.S.C. 154(b) by 0 days.

(21) Appl. No.: 11/912,094

(22) PCT Filed: Apr. 21, 2005

(86) PCT No.: PCT/KR2005/001146

§ 371 (c)(1),
(2), (4) Date: Oct. 19, 2007

(87) PCT Pub. No.: WO2006/112564

PCT Pub. Date: Oct. 26, 2006

(65) Prior Publication Data

US 2008/0197953 A1 Aug. 21, 2008

(51) Int. Cl.
*H01F 5/00* (2006.01)

(52) U.S. Cl. ..... 336/200

(58) Field of Classification Search ..... 336/65, 336/83, 200, 220–223, 232
See application file for complete search history.

(56) References Cited

U.S. PATENT DOCUMENTS 6,373,736 B2 * 4/2002 Matsumoto et al. ..... 363/147
6,927,661 B2 * 8/2005 He et al. ..... 336/200
7,375,609 B2 * 5/2008 Suzuki et al. ..... 336/200

FOREIGN PATENT DOCUMENTS

| | | |
|---|---|---|
| JP | 15158017 | 5/2003 |
| KR | 1020010023626 | 3/2001 |
| KR | 2001-79041 | 8/2001 |

* cited by examiner

*Primary Examiner*—Tuyen T. Nguyen
(74) *Attorney, Agent, or Firm*—Lowe Hauptman Ham & Berner, LLP

(57) ABSTRACT

Disclosed is a transformer having a multilayered winding structure. The transformer is supplied with alternating current power, and transfers the power to another circuit by electromagnetic induction. The transformer includes a core section having a hollow section, and primary and secondary windings isolated electrically from each other and wound around the core section. Each of the primary and secondary windings has a multilayered structure in which a plurality of metal plates are laminated with gaps therebetween and are coupled to each other at one side ends thereof, and the metal plates of the primary and secondary windings are inserted into and coupled to each other at the other side ends thereof in such a manner that the metal plates of the primary winding are alternately inserted into the gaps of the second windings. Thereby, it is possible to greatly reduce conduction loss generated from a high-frequency and high-capacity transformer, to improve voltage conversion efficiency, to greatly reduce an amount of discharging heat generated from the windings, and to efficiently discharge heat.

13 Claims, 5 Drawing Sheets

TRANSFORMER HAVING MULTI-LAYERED WINDING STRUCTURE

CROSS-REFERENCE TO RELATED APPLICATION

This application is the National Phase application of International Application No. PCT/KR2005/001146, filed Apr. 21, 2005, which designates the United States and was published in English. This application, in its entirety, is incorporated herein by reference.

TECHNICAL FIELD

The present invention relates to a transformer, and more particularly to a multilayered transformer, in which the winding structure of a transformer is constructed as a multilayered structure, thereby reducing core loss and conduction loss, which are problematic especially at high frequency, and providing high efficiency.

BACKGROUND ART

In general, a transformer is an electrical device that transfers alternating current power from one electrical circuit to another by means of electromagnetic induction. In the transformer, voltage and current are proportional to a winding ratio of the primary winding and the secondary winding (V1:V2=N1:N2=1/I1:1/I2). In an ideal transformer, it is possible to obtain energy conversion efficiency of 100% where input power is equal to output power. However, in a practical transformer, various losses take place, and thus the energy conversion efficiency is lowered.

The losses occurring at the transformer are generally classified into two types: core loss and conduction loss. The number of turns in the winding is proportional to the applied voltage, but inversely to a cross-sectional area of a core used. Even when the core is wound with a proper number of turns, the core loss takes place depending on variation in magnetic flux density and an exponential function of frequency.

Generally, the core loss can be reduced by appropriately selecting a type, size, etc. of the core to be used, and designing the core loss and the conduction loss so as to keep their balances in a proper way. In most cases, the winding for the transformer is mainly made of copper, except for some cases where aluminum is used in a high-capacity transformer due to its weight. Therefore, while the voltage is applied to the transformer and the current flows along the copper winding, power loss having a quantity corresponding to $I^2R$, i.e. the conduction loss called copper loss, takes place.

Further, when high frequency is applied to the winding of the transformer, its resistance value increases exponentially due to skin and proximity effects, and thus the conduction loss increases greatly. As a result, the conversion efficiency of the transformer is greatly lowered. Here, the skin effect refers to a phenomenon in which, when high-frequency current flows through a conductor, the current is concentrated on a surface of the conductor. Further, the proximity effect refers to a phenomenon in which, when high-frequency current flows through two parallel conductors, the current flows more intensively to portions of the conductors which are proximate to each other. At high frequency, the current concentrated on the surface of each conductor due to the skin effect leans to the opposite partial surfaces of the conductors due to the proximity effect.

FIGS. 1A and 1B illustrate a conventional single-layered one-turn transformer and a single-layered multi-turn transformer in a top plan view and a cross-sectional view, respectively.

In FIGS. 1A and lB, the left-hand figure is the top plan view, and the right-hand figure is the cross-sectional view that is taken along the line 140 of the left-hand figure. The single-layered transformers illustrated in FIGS. 1A and 1B are ones where primary windings 110 and 110' and secondary windings 120 and 120', which remove input and output terminals of voltage for the sake of convenience, are wound once (one turn) and multiple times (10 turns) around cores 130 and 130', respectively. The multi-turn transformer of FIG. 1B is merely different in the number of turns in the windings, and is almost similar in function, compared to the one-turn transformer of FIG. 1A.

As can be seen from the cross-sectional views of FIGS. 1A and 1B, even when a sufficiently thick conductor is used as the winding, the current in the primary and secondary windings 110' and 120' flows along the opposite surfaces alone due to the above-mentioned skin and proximity effects, and thus the conversion efficiency of the transformers is lowered. This drawback has a more serious influence at high frequency.

For example, even when a copper plate of 10 mm thick is wound, a skin depth of the copper plate at a frequency of 20 KHz is no more than about 0.5 mm at a room temperature. Accordingly, the cross-sectional area of the copper plate over which the current actually flows in the primary or secondary winding of the transformer is merely 5% of the entire cross-sectional area. The copper plate corresponding to the remaining 95% does not perform any other function than cooling as an incidental effect without acting as the conductor. Here, the skin depth refers to an equivalent current penetration depth at the conductor (e.g. the conductive line) through which the entire current has to flow with the same loss. The skin depth has only functional relationship with frequency and properties of the conductive line, and is characterized in that it is inversely proportional to a square root of frequency.

It is a multilayered transformer that is proposed in order to improve low conversion efficiency in the single-layered transformers of FIGS. 1A and 1B.

FIG. 2 is cross-sectional view of a conventional multilayered transformer.

In FIG. 2, the multilayered transformer is illustrated in the cross-sectional view in which a plurality of windings is constructed in a multiple layer after the cross-sectional view of the single-layered multi-turn transformer of FIG. 1B is rotated at an angle of 90° in the counterclockwise direction. In other words, the multilayered transformer is to stack the single-layered transformer in a multiple layer. In the multilayered transformer of FIG. 2, input and output terminals of each of windings 210 and 220 are also removed for the sake of convenience. When the primary windings 210 and the secondary windings 220 are sequentially stacked as in the multilayered transformer of FIG. 2, the area of the opposite copper plates for the primary winding 210 and the secondary windings 220 is doubled, compared to each of the single-layered transformers of FIGS. 1A and lB, and thus the area of the copper plate through which the current flow actually is also twice. That is to say, the multilayered transformer of FIG. 2 can obtain double conversion efficiency over each of the single-layered transformers of FIGS. 1A and 1B. A winding method used in the multilayered transformer of FIG. 2 is called a sandwich winding method. This sandwich winding method is adopted by most transformer manufacturers, thus being widely used. However, in spite of the sandwich winding method that is widely used at present, in the case of a high-frequency transformer, there occur large losses at the transformer. In the case of a high-frequency, high-capacity transformer, owing to the use of a large-size core, a voltage of several thousands of volts can be applied even with 10 turns or less. Thus, considering that the conversion efficiency of the transformer is proportional to the number of turns, the high-frequency, high-capacity transformer has still low conversion efficiency.

For example, in the case of 1,000 KW transformer having inputs of 1,000 V and 1,000 A, assuming that it is designed to have 10 turns at a frequency of 20 KHz, the current of 1,000 A should be fed to both surfaces of one copper pipe. In this case, a width of the copper pipe for the proper conversion efficiency of the transformer increases considerably, which makes it next to impossible to manufacture the copper pipe. Especially, because the skin depth is inversely proportional to the square root of frequency, the higher the frequency becomes, the lower the conversion efficiency becomes. Consequently, in order to maintain the proper conversion efficiency, there occurs a serious problem in that the width of the copper pipe increases considerably.

DISCLOSURE OF THE INVENTION

Therefore, the present invention has been made in view of the above-mentioned problems, and it is an objective of the present invention to provide a multilayered transformer, in which the winding structure of a transformer is constructed as a multilayered structure, thereby reducing core loss and conduction loss, especially which are problematic at high frequency, and providing high efficiency.

According to an aspect of the present invention, there is provided a transformer having a multilayered winding structure, in which alternating current power is supplied and transferred to another circuit by electromagnetic induction. The transformer includes: a core section having a hollow section; and primary and secondary windings isolated electrically from each other and wound around the core section. Each of the primary and secondary windings has a multilayered structure in which a plurality of metal plates are laminated with gaps therebetween and are coupled to each other at one side ends thereof, and the metal plates of the primary and secondary windings are inserted into and coupled to each other at the other side ends thereof in such a manner that the metal plates of the primary winding are alternately inserted into the gaps of the second windings.

BRIEF DESCRIPTION OF THE DRAWINGS

The foregoing and other objects, features and advantages of the present invention will become more apparent from the following detailed description when taken in conjunction with the accompanying drawings in which.

BEST MODE FOR CARRYING OUT THE INVENTION

Reference will now be made in detail to the preferred embodiments of the present invention.

Figure 3:
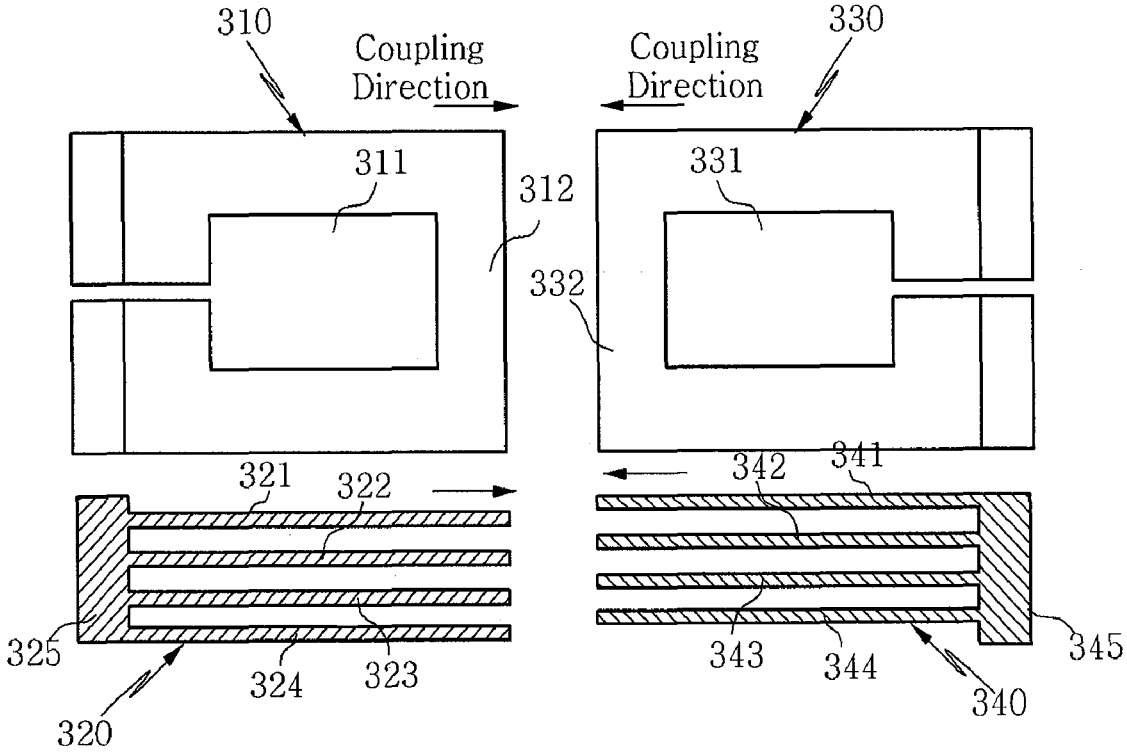
FIG. 3 illustrates each core and each winding before assembling a transformer having a multilayered winding structure according to an exemplary embodiment of the present invention in a top plan view and a side view.

FIG. 3 illustrates each core and each winding before assembling a transformer having a multilayered winding structure according to an exemplary embodiment of the present invention in a top plan view and a side view.

In FIG. 3, each upper figure is the top plan view of each core, and each lower figure is the side view of each winding. In FIG. 3, a primary core 310 and a secondary core 330 have rectangular hollow sections 311 and 331 respectively, take a quadrilateral shape where one side is opened, and are of a size and shape. A primary winding 320 has a multilayered structure with the total of four layers, a first layer 321, a second layer 322, a third layer 323, and a fourth layer 324. Each of the layers 321 to 324 has the form of a flat plate having the same thickness, and is spaced apart from each other at a constant interval. Each of the layers 321 to 324 is branched off from an input terminal.

A secondary winding 340 is also similar to the primary winding 320, can be inserted into the primary winding 320 in an alternate way, and has a structure in which the primary winding 320 is turned upside down. Each interval between first to fourth layers 341 to 344 of the secondary winding 340 is equal to that between the first to fourth layers 321 to 324 of the primary winding 320. Further, each of the first to fourth layers 341 to 344 of the secondary winding 340 is branched off from an output terminal.

Meanwhile, among two types of arrows indicated in FIG. 3, one indicates a coupling direction of the primary core 310 and the secondary core 330, and the other indicates a coupling direction of the primary winding 320 and the secondary winding 340, which are wound around the cores 310 and 330, respectively. In FIG. 3, the primary core 310 and the secondary core 330 are coupled to each other with a primary inner periphery 312 and a secondary inner periphery 332 opposite to each other.

Meanwhile, the primary winding 320 and the secondary winding 340 according to an embodiment of the present invention can be formed of copper, aluminum or the like.

Figure 4:
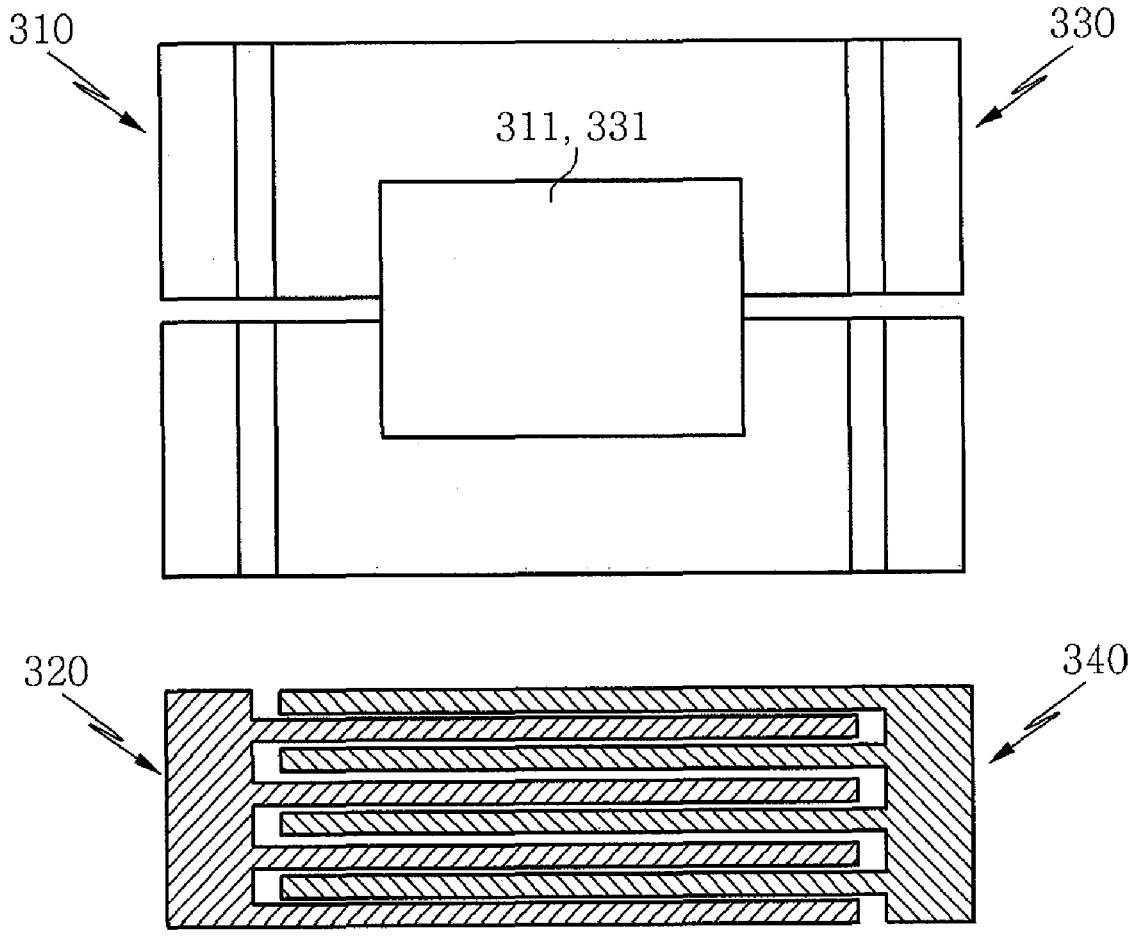
FIG. 4 illustrates each core and each winding after assembling a transformer having a multilayered winding structure according to an exemplary embodiment of the present invention in a top plan view and a side view.

FIG. 4 illustrates each core and each winding after assembling a transformer having a multilayered winding structure according to an embodiment of the present invention in a top plan view and a side view.

In FIG. 4, an upper figure is the top plan view of the assembled cores, and a lower figure is the side view of the assembled windings. In the assembled state of FIG. 4, the hollow sections 311 and 331 of the primary and secondary cores 310 and 330 described with reference to FIG. 3 are displaced until they overlap with each other in a linear direction where the primary and secondary cores 310 and 330 are opposite to each other. The primary and secondary windings 320 and 340, which are wound around the cores 310 and 330 respectively, are also coupled so that their respective layers are opposite to each other. In the pre-assembly state of FIG. 3, the secondary winding 340 should be wound around the secondary core 330 at a position where it can be inserted into the primary winding 320 wound around the primary core 310 in an alternate way. Further, when the primary and secondary windings 320 and 340 are coupled to each other, the coupling is carried out in such a manner that the gaps between the layers 321 to 324 of the primary winding 320 and the gaps between the layers 341 to 344 of the secondary winding 340 are filled alternately.

When the windings have a multilayered structure as in the side view of FIG. 4, a cross-sectional area of the windings through which the current flows actually increases in proportion to the number of layers, and thus the conversion efficiency of the transformer increases as well.

Figure 1A:
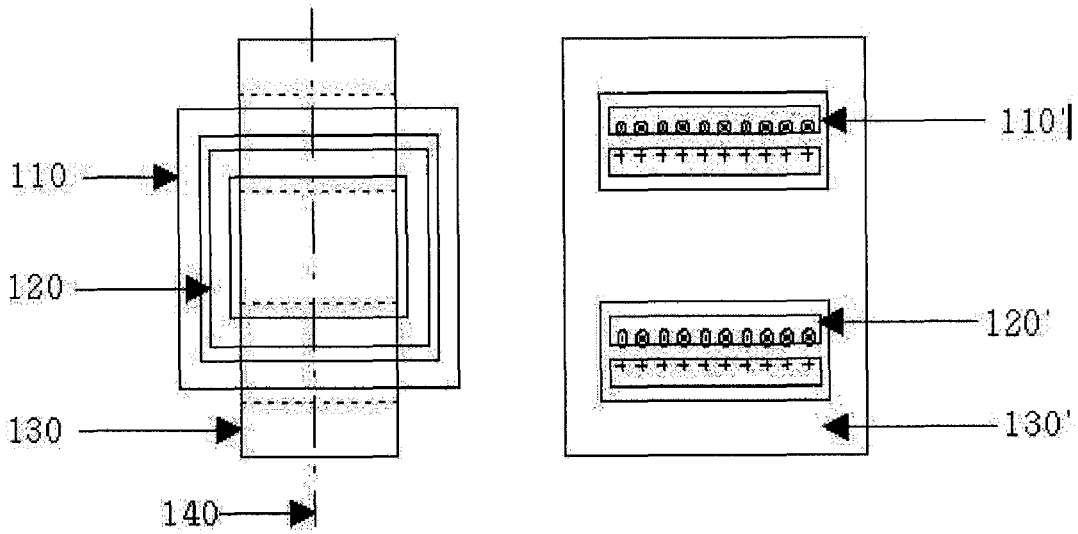
FIGS. 1A and 1B illustrate a conventional single-layered one-turn transformer and a single-layered multi-turn transformer in a top plan view and a cross-sectional view, respectively.
Figure 1B:
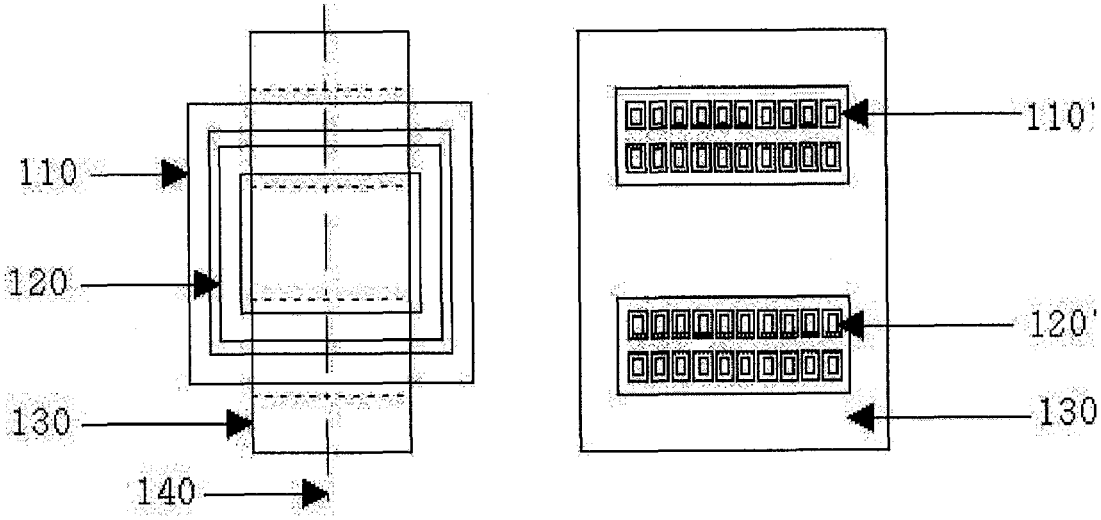
Figure 2:
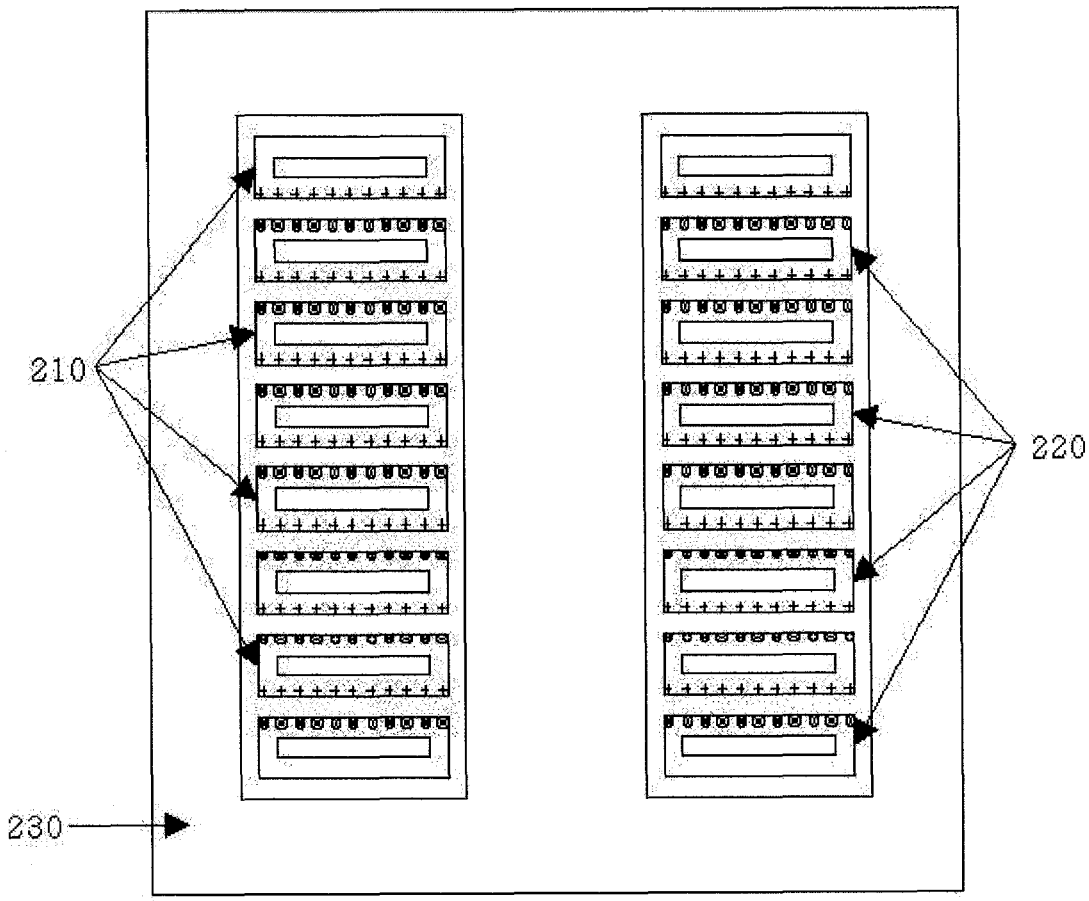
FIG. 2 is a cross-sectional view of a conventional multilayered transformer.

More specifically, in the case of the multilayered transformer described with reference to FIG. 2, the current flows on two surfaces of each winding at each turn. Since each turn is applied to both the primary winding 210 and the secondary winding 220, the current flows on four surfaces of the windings at each turn when both of the windings 210 and 220 are considered together.

In contrast, in the case of the multilayered winding structure shown in FIG. 4, considering that each of the primary and second windings 320 and 340 has four layers, and thus the current flows on two surfaces per layer, the current flows on eight surfaces at each turn with respect to each of the primary and second windings 320 and 340. Therefore, when both of the primary and second windings 320 and 340 are considered together, the current flows on 16 surfaces of the windings at each turn. Accordingly, as compared to the multilayered transformer where the single-layered transformers aforementioned with reference to FIG. 2 are sequentially stacked, and where the current flows on the four surfaces, the voltage conversion efficiency is improved four times only with one turn. In other words, when the four-layered transformer described with reference to FIG. 2 has the same height as the transformer having the four-layered winding structure according to an embodiment of the present invention, the latter has the same effect as when the conduction loss is reduced to a quarter.

Meanwhile, the description of FIG. 4 is made about the transformer having four layers per turn in the winding by way of example, but the present invention is not limited to this construction. In other words, in the multilayered winding structure according to the technical spirit of the present invention, the number of layers per turn in the winding can be two or three, or four or more.

In the transformer having multilayered winding structure according to an embodiment of the present invention, the number of layers per turn in the winding can be determined based on a skin depth, which is dependent on a bandwidth of a used alternating current frequency, and target voltage conversion efficiency. For example, as the alternating current frequency used in the transformer becomes high, i.e. as the skin depth becomes thin, and as the target voltage conversion efficiency becomes high, the number of layers per turn in the winding is preferably increased.

Although not shown in FIG. 4, in the state where the primary and secondary windings 320 and 340 are coupled to each other, the gaps between the layers of each winding are insulated with a predetermined insulating material. Further, each layer of the primary and secondary windings 320 and 340 has a thickness less than that of the gap between the layers in each of the coupled primary and secondary windings 320 and 340.

Figure 5:
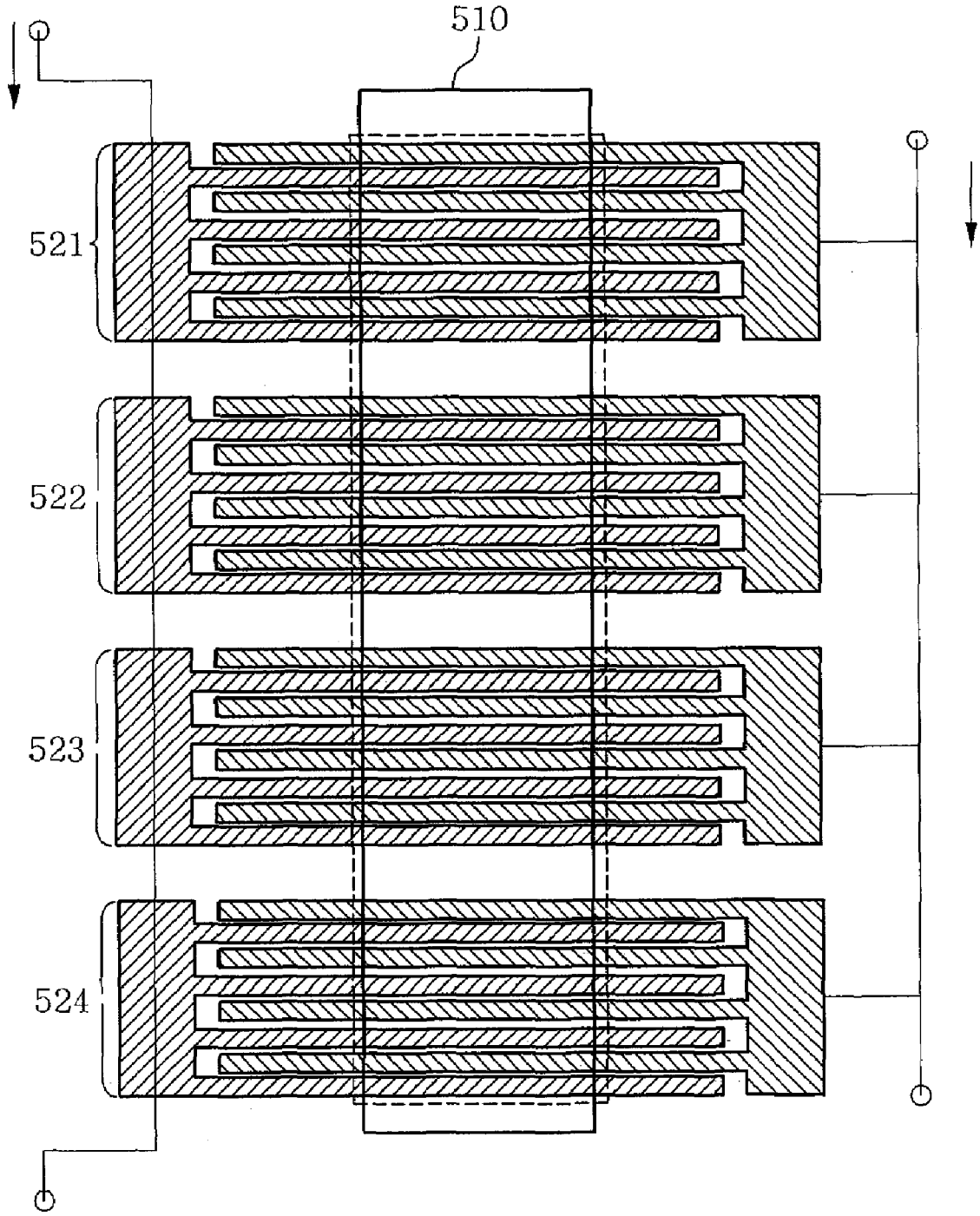
FIG. 5 illustrates a transformer having a four-turn multilayered winding structure according to an exemplary embodiment of the present invention.

FIG. 5 illustrates a transformer having a four-turn multilayered winding structure according to an exemplary embodiment of the present invention. The transformer having a four-turn multilayered winding structure illustrated in FIG. 5 is one where a four-layered winding is wound four times around a core 510. Each of windings 521 to 524 is wound around the core 510 at a constant interval. In the transformer having multilayered winding structure according to an embodiment of the present invention, the number of turns in the winding will be appropriately set based on target voltage conversion efficiency and a height of the core 510. In other words, in order to improve the target voltage conversion efficiency, the number of turns in the winding should be increased. However, the number of turns in the winding should be increased within a range where the height of the core 510 is considered.

Meanwhile, in the transformer having a multi-turn multilayered winding structure as in FIG. 5, each of the windings 521 to 524 can be connected to each other outside the windings. As a method of connecting each of the windings 521 to 524, the primary windings or the secondary windings can be all connected in series or in parallel. For example, as illustrated in FIG. 5, when the primary windings are all connected in series, and when the secondary windings are all connected in parallel, a high-efficiency transformer having a winding ratio of 4:1 is obtained in view of the theory of the transformer.

Further, in the case of the high-capacity transformer, it is important to discharge heat because the heat generated from the windings increases considerably. Hence, the use of the transformer having the multilayered winding structure as in the embodiment of the present invention allows the number of turns in the winding to be reduced under the same voltage conversion efficiency, compared to the conventional multilayered transformer. Thus, an amount of heat generated from the winding can be structurally reduced by itself.

When a more delicate work for discharging heat is required, a cooling water channel connecting start and end points of each of the windings 521 to 524 can be formed along a surface of each layer of the windings 521 to 524. Then, if cooling water is fed to the cooling water channel, the effect of discharging heat can be improved.

Meanwhile, according to the present invention, the process of connecting each of the windings 521 to 524 and the process of forming the cooling water channel for each of the windings 521 to 524 are widely used in the conventional transformer or water-cooled transformer, and thus well-known to those skilled in the art. Thus, their detailed description will be omitted.

Although the invention has been shown and described with reference to exemplary embodiments thereof, it will be apparent to those skilled in the art that various changes in form and details may be made therein without departing from the scope and spirit of the invention as disclosed in the accompanying claims. Accordingly, it should be understood that the above-described embodiments are illustrative rather than restrictive in all aspects. In other words, the scope of the invention is represented by the claims below, rather than the detailed description, and thus all changes or modifications derived from the meanings and scope of the claims, and their equivalent concepts should be interpreted as falling within the scope of the present invention.

INDUSTRIAL APPLICABILITY

As described above, when the conventional multilayered transformer is used for high frequency or high capacity, various losses such as the conduction loss increase greatly, and thus the voltage conversion efficiency is greatly lowered. However, according to the present invention, the winding structure itself is designed as the multilayered structure, various losses such as the conduction loss are greatly reduced, and thus the voltage conversion efficiency can be improved.

Further, in the case of the conventional high-capacity transformer, the width of copper pipe used as the winding increases greatly, and thus the case where it is impossible to manufacture it in practice takes place. However, the transformer having the multilayered winding structure according to the present invention reduces the number of turns in the winding under the same voltage conversion efficiency, and thus the amount of generated heat can be greatly reduced, compared to the conventional high-capacity transformer.

The invention claimed is:

1. A transformer having a multilayered winding structure, which is supplied with alternating current power and transfers power to a circuit by electromagnetic induction, the transformer comprising:

a core section having a hollow portion; and primary and secondary windings electrically isolated from each other and wound around the core section, wherein each of the primary and secondary windings has a multilayered structure in which a plurality of metal plates are laminated with gaps therebetween and are coupled to each other at one side ends thereof, and the metal plates of the primary and secondary windings are inserted into and coupled to each other at the other side ends thereof in such a manner that the metal plates of the primary winding are alternately inserted into the gaps of the second windings.

2. The transformer according to claim 1, wherein the metal plates each have a flat cuboidal shape having predetermined thickness and height.

3. The transformer according to claim 1, wherein the primary and secondary windings have the same number of metal plates and are mirror symmetric in shape.

4. The transformer according to claim 3, wherein the metal plates number at least two, and the number of metal plates is determined dependent on a frequency bandwidth used in the transformer and target voltage conversion efficiency.

5. The transformer according to claim 4, wherein the number of metal plates increases as the frequency bandwidth becomes wider, as frequency becomes higher and as the target voltage conversion efficiency becomes higher.

6. The transformer according to claim 1, wherein the number of turns which the primary and secondary windings have on the core section is at least one.

7. The transformer according to claim 6, wherein a constant interval is left between each turns which are formed by the primary and secondary windings inserted alternately into each other.

8. The transformer according to claim 6, wherein the number of turns is determined dependent on target voltage conversion efficiency and a height of the core section.

9. The transformer according to claim 1, wherein, when the number of turns is equal to or exceeds two, one or more primary windings are connected in series by an electric cord connecting an input terminal, and one or more secondary windings are connected in parallel by an electric cord connecting an output terminal.

10. The transformer according to claim 9, wherein the primary and secondary windings each have a cooling water channel to which cooling water for discharging generated heat is fed and which is formed on each metal plate of the primary and secondary windings.

11. The transformer according to claim 1, wherein the gap is larger than a thickness of the metal plate.

12. The transformer according to claim 1, wherein the metal plates of the primary and secondary windings are electrically isolated from each other.

13. The transformer according to claim 6, wherein, when the number of turns is equal to or exceeds two, one or more primary windings are connected in series by an electric cord connecting an input terminal, and one or more secondary windings are connected in parallel by an electric cord connecting an output terminal.

* * * * *